United States Patent [19]

Kuhn

[11] Patent Number: 4,727,661

[45] Date of Patent: Mar. 1, 1988

[54] FOOTWEAR WITH REMOVABLE INSOLE

[76] Inventor: Margrit Kuhn, Salzstrasse 8, CH-8437 Zurzach, Switzerland

[21] Appl. No.: 936,120

[22] Filed: Dec. 1, 1986

[30] Foreign Application Priority Data

Dec. 5, 1985 [CH] Switzerland ..... 5178/85

[51] Int. Cl.[4] ..... A43B 3/24; A43B 13/40

[52] U.S. Cl. ..... 36/100; 36/43

[58] Field of Search ..... 36/43, 44, 71, 100, 36/101; 128/601, 602, 603, 604

[56] References Cited

U.S. PATENT DOCUMENTS

| | | | |
|---|---|---|---|
| 1,907,997 | 5/1933 | Nickerson | 128/604 |
| 2,411,479 | 11/1946 | Tarlow | 36/43 |
| 2,482,333 | 9/1949 | Everston | 36/43 |
| 2,495,984 | 1/1950 | Roy | 36/11.5 |
| 3,436,845 | 4/1969 | Sachs | 36/101 |
| 3,538,628 | 11/1970 | Einstein, Jr. | 36/100 |
| 3,890,725 | 6/1975 | Lea et al. | 36/11.5 |
| 4,095,353 | 6/1978 | Foldes | 36/11.5 |
| 4,598,484 | 7/1986 | Ma | 36/43 |

FOREIGN PATENT DOCUMENTS

| | | | |
|---|---|---|---|
| 432340 | 8/1926 | Fed. Rep. of Germany | 128/604 |
| 2523299 | 12/1976 | Fed. Rep. of Germany | 36/101 |
| 2845880 | 4/1980 | Fed. Rep. of Germany . | |
| 3330060 | 2/1985 | Fed. Rep. of Germany | 36/43 |
| 2539966 | 8/1984 | France | 36/43 |
| 146149 | 11/1979 | Japan | 36/43 |

OTHER PUBLICATIONS

"Self-Adhering Nylon Tapes", Journal of the AMA, Mavrice Gershman M.D., 10/18/58.

*Primary Examiner*—Steven N. Meyers

*Attorney, Agent, or Firm*—Willian Brinks Olds Hofer Gilson & Lione Ltd.

[57] ABSTRACT

The invention relates to an article of footwear having a removable insole. The insole has nubs and magnetic metal parts on its upper surface for massaging the foot reflex zones. Snap fasteners fasten the insole to the sole. Each snap fastener has an upper part mounted on the lower surface of the insole opposite the magnetic metal part, and a lower part mounted on the sole.

4 Claims, 3 Drawing Figures

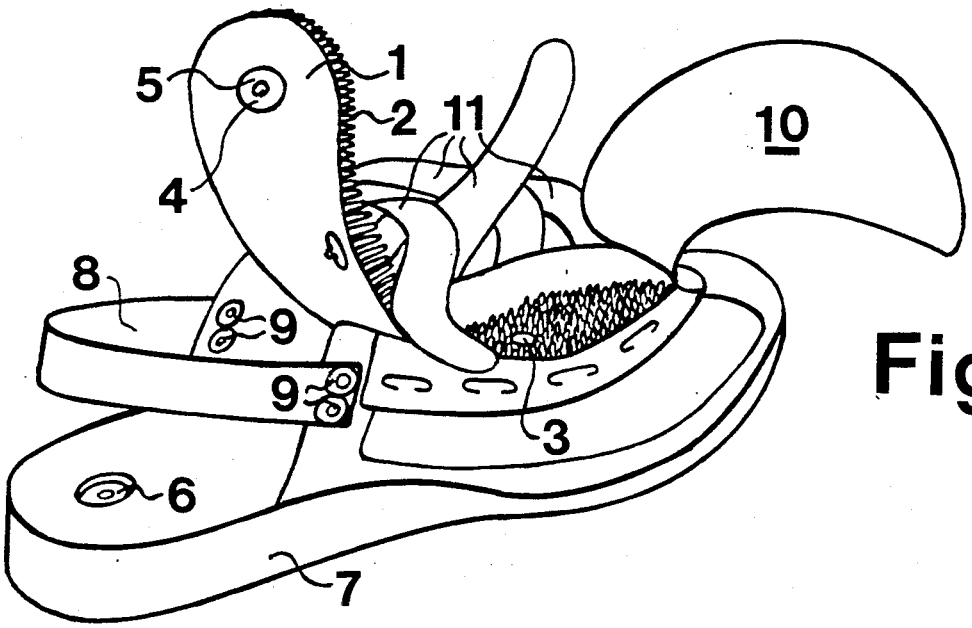
Fig.1
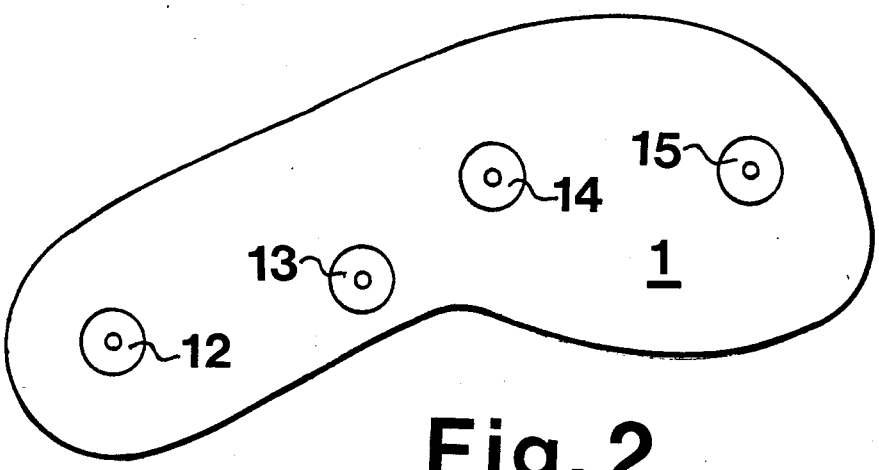
Fig. 2
Fig.3
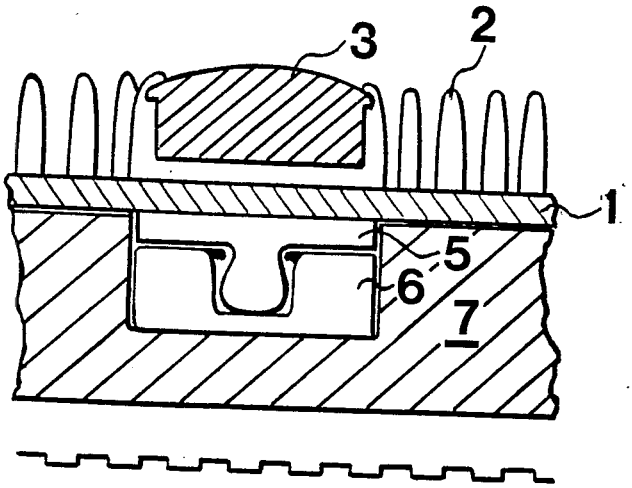

FOOTWEAR WITH REMOVABLE INSOLE

BACKGROUND OF THE INVENTION

The present invention relates to an article of footwear having a removable insole.

In health-conscious circles and among working class people who must stand or walk a great deal, shoes with nubbed insoles are widely used and well-liked. Insoles are also known to have, in addition to the nub-type surface, magnetic metal parts at the four main points of the foot reflex zones. Shoes having such nubbed insoles are known to be available in open or half-open styles; however, in these styles the insole is typically joined solidly and undetachably to the sole of the shoe to prevent the insole from slipping about.

Non-removable nubbed insoles have been found to be undesirable because the space between the nubs tends to collect dirt, thus requiring the non-detachable insole (and hence the entire shoe) to be washed frequently. This care convenience, unfortunately, requires that the upper material of the shoe be made of a machine washable material, such as rubber or plastic, which is unappealing to many people.

Shoe structures with removable insoles have long been known in the art. However, the nubbed insoles with magnetic metal parts of which the present inventor is aware are solidly joined with the shoe sole. The reason for this is that such insoles have been used primarily in open or half-open shoe styles, and insoles simply laid in the shoe in the absence of a guide would inevitably slip about their entire border during walking. In an attempt to solve these problems, much effort has been expended in devising suitable methods of securing a removable insole to the sole.

German unexamined patent specification OS No. 28 45 880, for example, gives one proposed solution to this problem. It suggests connecting, in the heel zone, the insole to the sole using a burr closure material, such as that marketed under the tradename VELCRO. The problems associated with a poor connection of the insole, however, are not satisfactorily solved, since the forces created during walking also act upon the non-rigid front portion of the insole, causing the front portion of the insole to be displaced.

SUMMARY OF THE INVENTION

The present invention provides an article of footwear having a removable insole adapted to provide foot reflex zone massaging action. The removable insole has an upper and lower surface. On the upper surface is a plurality of nubs from about 1 to 12 mm in length for massaging the foot reflex zone. In addition, the upper surface also has a plurality of magnetic metal parts, preferably about four, for massaging the four main points of the foot reflex zone. The article of footwear of the present invention also has a plurality of snap fasteners for securing the nubbed removable insole to the sole. Each snap fastener has an upper and lower part. The upper snap fastener part is mounted on the lower surface of the insole opposite a respective one of the magnetic metal parts, while the lower snap fastener part is mounted on the sole.

In a preferred embodiment of the invention, the upper and lower snap fasteners parts are made of either metal or synthetic material. Metal snap fasteners parts are physically or adhesively mounted to the sole and insole, while synthetic snap fastener parts are welded to the sole and insole.

One advantage of the footwear of the present invention is that it retains both the care convenience and comfort of a nubbed removable insole, while concomitantly providing a secure attachment of the insole to the sole of the footwear. Another advantage is that the removable insole of the present invention can be accommodated in a variety of shoe models, particularly open and half-open styles.

BRIEF DESCRIPTION OF THE DRAWINGS

A presently preferred embodiment of the footwear of the invention is illustrated, by way of example, in the drawings, in which:

FIG. 1 is a perspective view of a presently preferred embodiment of an insole that is partially installed in an article of footwear;

FIG. 2 is a bottom view of the insole of FIG. 1; and

FIG. 3 is a side sectional view of the embodiment of FIG. 1, showing the insole and the sole of the footwear connected with a snap fastener.

DETAILED DESCRIPTION OF A PRESENTLY PREFERRED EMBODIMENT OF THE INVENTION

FIG. 1 is a perspective view of the features of a presently preferred embodiment of the invention. The snap fasteners 4 connect the insole 1 to the sole 7. The upper surface of the insole 1 has nubs 2 and a magnetic metal part 3 for the massage of one of the four main points of the foot reflex zones. The lower surface of the insole shows the upper snap fastener parts 5, which, in accordance with the present invention, each lie opposite a respective one of the magnetic metal parts 3. The lower snap fastener parts 6 are embedded in the sole 7 of the footwear. By means of four such specially arranged snap fasteners the insole can be removed easily and, after cleaning, reinstalled. Cleaning in a washing machine still remains practicable.

Since shoes with such insoles are liked especially among people who work indoors, open and half-open shoes are preferred in combination with the insole of the present invention.

FIG. 1 shows a half-open shoe style, in which the ankle band 8 is also fastened with snap fasteners 9. Both open and half-open styles can therefore be used. In order for the shoe to be adaptable to various sizes, it is provided with a step-in opening cut especially far forward toward the front of the shoe. This is covered by the tongue 10 and fastened with flaps 11 made of a burr closure material, such as that marketed under the tradename of VELCRO. This type of closure permits stepless adjustability and assures an excellent fit for different foot sizes and instep heights.

In FIG. 2 the insole of FIG. 1 is represented from a bottom view. The arrangement of the snap fastener parts is important: the fasteners are distributed on the lower surface of the insole 1 at the four main points 12, 13, 14 and 15 of the foot reflex zones. This particular distribution of the snap fasteners further reinforces the effect of the magnetic metal parts on the opposite side, and assures that the insole is firmly held in place. Since the insole is preferably made of rubber, it can be removed by passing a finger under the insole and releasing the connection between the snap fastener parts. The wide opening in the upper material further assures accessibility to the snap fastener 15 in the toe region. The four reflex zone massage points, mentioned above, are believed to have the following stimulation effects: point 12 is associated with hormone economy and vitality, point 13 with the spinal column, point 14 with the internal organs, such as the pancreas, stomach, intestine, liver, kidneys, etc., and finally point 15 with the head, especially eyes and hearing.

FIG. 3 shows a cross sectional view through one of the snap fasteners 4 of the embodiment of FIG. 1. The snap fastener parts 5 and 6 are fastened, for example, by mounting physically or with an adhesive, or by welding, to the respective surfaces of the insole 1 or sole 7. Snap fasteners made of synthetic materials are preferably welded to their respective mounting surfaces, while those made of metal are physically mounted using adhesives, rivets, or the like. Also shown are the nubs 2 and a magnetic metal part 3. The lower snap fastener parts 6 are embedded in the sole 7 of the footwear, so that the insole 1 rests flat on the sole 7 at the fastening points. The snap fastener can be made of any suitable material, such as metal or plastic. Accordingly, the insole can be removed for machine washing. A substantial advantage of the invention over known shoes thus lies in the combination of the insole having a stimulating action through the foot reflex zones with a practical and pleasing upper shoe part, without having to compromise ease of care.

Various other changes and modifications to the preferred embodiments described herein will be apparent to those skilled in the art. Such changes and modifications can be made without departing from the spirit and scope of the present invention and without diminishing its attendant advantages. It is, therefore, intended that all such changes and modifications be covered by the following claims.

I claim:

1. In an article of footwear of the type comprising a sole, and an insole with an upper and lower surface, said upper surface having a plurality of nubs from about 1 to 12 mm in length for massaging at a foot reflex zone, said upper surface also having a plurality of magnetic metal parts mounted thereon for massaging at four main points of a foot reflex zone, the improvement comprising:

a plurality of snap fasteners for removably fastening said nubbed insole to said sole, each snap fastener comprising an upper part mounted on the lower surface of the insole directly below a respective one of said magnetic metal parts, and a lower part mounted on the sole.

2. The footwear of claim 1, wherein at least one snap fastener is made of metal, said upper and lower parts of said snap fastener being mounted respectively to the insole and sole.

3. The footwear of claim 1, wherein at least one snap fastener is made of synthetic material, said upper and lower parts of said snap fastener being welded respectively to the insole and sole.

4. The footwear of claim 1, wherein at least one snap fastener is made of synthetic material, said upper and lower parts of said snap fastener being mounted respectively to the insole and sole.

* * * * *